United States Patent [19]

Jacob et al.

[11] 4,018,335

[45] Apr. 19, 1977

[54] DISPLAY PACKAGE

[75] Inventors: Pascal Marie Henri Jacob; Gerard Pierre Guichesseux, both of Paris, France

[73] Assignee: Societe Anonyme pour l'Equipement Electrique des Venicules S. E. V. Marchal, Issy Les Moulineaux, France

[22] Filed: June 21, 1976

[21] Appl. No.: 698,024

[30] Foreign Application Priority Data

June 26, 1975 France ..... 75.20101

[52] U.S. Cl. ..... 206/422; 206/419; 229/22

[51] Int. Cl.² ..... B65D 85/42

[58] Field of Search ..... 206/45.31, 45.34, 418–420, 206/422, 436, 486, 521, 523, 526, 822; 229/22, 39 B; 220/DIG. 13

[56] References Cited

UNITED STATES PATENTS

| | | | |
|---|---|---|---|
| 3,405,799 | 10/1968 | Weller et al. | 206/422 |
| 3,583,559 | 6/1971 | Brander | 206/422 |
| 3,638,848 | 2/1972 | Heyworth | 229/22 X |

FOREIGN PATENTS OR APPLICATIONS

| | | | |
|---|---|---|---|
| 1,475,780 | 2/1967 | France | 206/420 |

*Primary Examiner*—Steven E. Lipman
*Attorney, Agent, or Firm*—Brisebois & Kruger

[57] ABSTRACT

Display package for fragile articles such as automotive headlights consists for example of prism of resilient material having a polygonal bottom and vertical sides. A seat for a fragile article extends inward from each side and narrows as it approaches its inner end. The walls of the seat are provided with grooves and projections which mate with portions of the article to be received therein.

20 Claims, 9 Drawing Figures

DISPLAY PACKAGE

SUMMARY OF THE INVENTION

It is well known that automotive vehicles are frequently equipped by their users with headlights which are not mounted on the vehicle by the manufacturer and which may nevertheless render easier to drive the car, particularly under difficult conditions of use. These headlights may be of various shapes, circular or rectangular for example, and they may be sold singly or in pairs.

The packaging of these headlights poses a safety problem because the headlights are very fragile and must consequently be protected from shocks during transportation or storage. Moreover, it is highly desirable that the eventual purchasers be able to see the headlights which they are about to buy without being required to open the package because the opening of the package may lead, if the package is poorly reclosed, or the prospective purchaser handles the headlight roughly, to damage to the product sold.

It is the object of the present invention to provide a display package which permits the prospective purchaser to see the headlight or headlights which it contains, thus avoiding any need for the purchaser to open the package in order to see the product he wants to buy. The package according to the invention also makes it possible to perfectly protect the headlights sold from possible shocks. It is, moreover, easy to store and inexpensive.

It is consequently an object of the present invention to provide a new article of manufacture which consists of a display package adapted to hold at least one fragile article such as an automotive headlight, for example, which is characterized by the fact that the container is in the form of a prism having a polygonal base, at least one of the lateral faces of the prism being partially hollowed out to provide at least one seat formed in the container, and comprising on opposite sides of the median plane of the seat which is parallel to the corners of the prism, and behind the opening in the corresponding lateral surface of the prism which leads to said seat, at least one groove substantially parallel to the corners of the prism.

In a preferred embodiment the receptacle is a right prism. The median plane of each seat in the container, which is parallel to the corner of the prism formed by said container, is substantially perpendicular to the side of the container having the opening leading to said seat. Each seat provided in the container is laterally defined by walls parallel to the corner of the prism. In the vicinity of the part of each seat which is farthest from the side having the opening which leads to said seat, near the base of the prism which constitutes the container are recesses having a cross section having the shape of the base of the article to be stored in the seat.

The material constituting the prism is elastically deformable and each groove has a width slightly less than the width of the edge of the stored article which fits into said groove. The maximum dimension of the articles stored, perpendicularly to the groove or grooves, is slightly greater than the distance between the bottom of the groove and the wall thereopposite. The wall which is opposite the bottom of the groove is the bottom of another groove. When the article stored is a vehicle headlight, each seat comprises, in the zone thereof farthest from the side having an opening leading to said seat and near a base of the prism constituting the container, at least one projection in the seat behind the groove or grooves. Each seat also comprises in the zone thereof farthest from the side having the opening leading thereto and near the base of the prism which constitutes the container at least one partition transversely connecting the two lateral walls defining the seat. This partition is rounded and supports the rear of the headlight.

The cover associated with the receptacle consists of a prismatic sheet defining lateral walls which are connected at one of their edges to a bottom, said lateral walls defining an internal volume in which the said prismatic container may be received, the lateral sides of the cover being equipped with a transparent zone in alignment with each opening formed in a lateral surface of the prismatic receptacle and the bottom of the cover overlying the prismatic surface of the container into which the seat or seats provided in said container open. The polygonal surface of the prism which constitutes the container may be a triangle, square or rectangle. The container is made of an expanded plastic material such as polystyrene. The cover is made of cardboard.

In a first embodiment the display package according to the invention is adapted to hold two identical articles. In this case the polygonal surface of the prism which constitutes the receptacle is a right isosceles triangle, and an opening leading to a seat is located in each of the two faces of the prism which correspond to the equal sides of the isosceles triangle. If the receptacle is a right prism, the median planes of each of the two seats parallel to the corners of the prisms meet along a line parallel to the corners of the prism passing through the center of the hypotenuse of the triangle surface of the prism. The display package comprises a cover constituted by a prismatic surface, said cover comprising a handle along the corner of the prismatic surface which corresponds to the apex of the triangle which is a right angle.

In another embodiment the display package according to the invention comprises a cover having a prismatic surface which simultaneously grips several independent containers which are preferably identical.

In yet another embodiment each seat provided in the prismatic container comprises several parallel grooves on the same side of its median plane parallel to the corners of the prism. The parallel grooves positioned on the same side of the median plane of a seat have widths and thicknesses which are different. Their distances from the median plane of the seat may also be different.

In an embodiment adapted to the storage of a large number of articles the base polygon of the prismatic container is a rectangle and the container forms an elongated strip inside which the stored articles are positioned top to bottom and staggered, all the median planes of the seats being perpendicular to the major side of the elongated strip, the distance between two successive median planes being slightly greater than the maximum width of a stored article, measured parallel to the longitudinal axis of the elongated strip.

It is clear that the use of a display package according to the invention for the storage of vehicular headlights makes it possible, for a very limited price, on the one hand, to provide efficacious protection for the headlights during transportation and storage and, on the other hand, to provide a display which is attractive to the eye, permitting the possible purchaser to see the headlight on sale without any need to open the package. The package is compact since the bulkiest part of the projectors, to wit the front end, is near the surfaces of the prism which constitute the container, the rear parts of the different headlights stored in a given container converging toward the inside of the prism but not touching each other because of the small volume which these rear parts of the headlights occupy. The safety of the package constructed in this manner is perfectly assured for each headlight because the edge of the lens of the headlight is retained in a groove and the casing of the headlight is supported by the projections in the lower part of each seat. Moreover, it should be noted that the glass lenses of the headlights are inset so as to prevent them from engaging an outside object.

The cover may of course advantageously carry any suitable advertising material, such as information relative to the type of article stored in the package according to the invention. In the case in which the package is a right prism having a prismatic surface in the shape of a right isosceles triangle the handle of the package is positioned at the corner of the prismatic surface which corresponds to the right angle of the isosceles triangle, the package being adapted to rest on the lateral face of the prism which corresponds to the hypotenuse of the triangle. This arrangement makes it possible to increase the safety of transportation.

In order that the object of the invention may be better understood several embodiments thereof will now be described, purely by way of illustration and example, with reference to the accompanying drawings on which:

Figure 8:
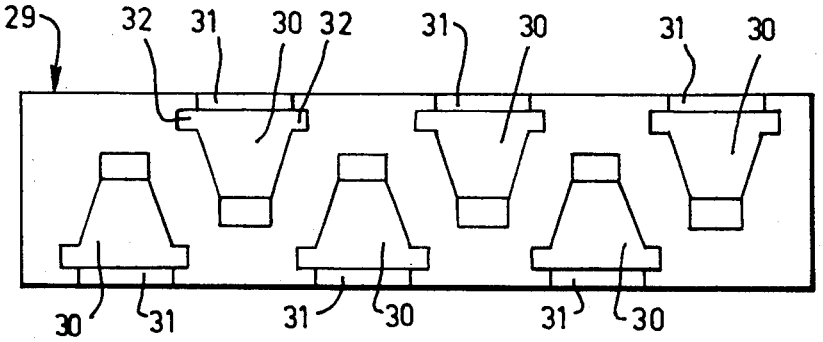
Figure 9:
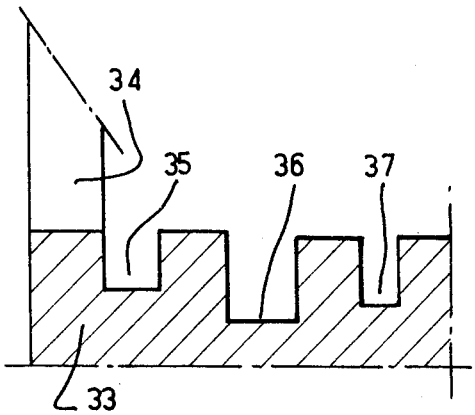

FIG. 8 is a schematic plan view showing a display package according to the invention the container of which has a rectangular base, said package being adapted to receive a plurality of automotive headlights; and FIG. 9 is a partial detail view in section showing the wall of a seat of a receptacle in which several parallel grooves having different dimensions have been provided to permit the storage in said seat of several different types of headlights.

Referring now to FIGS. 1 to 4, it will be seen that reference numeral 1 indicates the container of the display package as a whole.

The container 1 is made of expanded molded polystyrene and has the general shape of a right prism having rectangular sides and a base which is a right isosceles triangle. The container 1 is associated with a cover 2 having a prismatic surface of the same shape and dimensions as the prismatic surface defined by the lateral sides of the container 1. The lateral sides surrounding the prismatic surface of the cover 2 are connected to each other at each edge by a bottom 2*a*. The cover 2 is made of cardboard and the surfaces 2*b* and 2*c* which correspond to two equal sides of the cover are provided with circular ports 3 made of a transparent material such as the one sold under the tradename RHODIALINE. The cover 2 comprises a handle 4 at the corner which corresponds to the right angle of its triangular surface. The cover 2 may be manufactured without difficulty by cutting a sheet of cardboard which is then bent and stuck together, the handle 4 being formed by sticking together two identical cut out zones.

The container 1 holds two identical headlights 5 the lenses 5*a* of which are connected to the parabolic casing 5*b* by a rim 6. The casing 5*b* is connected to rear part 7. The container 1 has a triangular bottom formed by a continuous sheet 8 while the triangular top is defined only by the outer edges of the side walls and certain numbers of internal walls of the prism which are parallel to the corners of the prism. In each of the two side walls 1*b* and 1*c* of the prism, each of which intersects one of the sides of the triangular base adjacent to the right angle of said triangular base, are openings 9 and 10 respectively in the surfaces 1*b* and 1*c*. Reference numeral 1*a* has been applied to the third side wall of the prism constituting the container 1. The openings 9 and 10 lead into the two seats formed inside the container and are open along one edge perpendicular to the corners of the prism. These two seats are symmetrically positioned with respect to the plane bisecting the right dihedral angle of the prism which constitutes the container 1. The median planes of these two seats, which are parallel to the corners of the container, are perpendicular respectively to the surfaces 1*b* and 1*c* of the prism. Each seat is partially defined by two lateral walls parallel to the corners of the prism, these walls being indicated by reference numerals 11*a*, 11*b* for the seat which opens through the surface 1*b*, and 12*a*, 12*b* for the seat which opens through the surface 1*c*. The walls 11*b* and 12*b* are connected together at their ends and are connected to the lateral sides of the prism which constitutes the container in the area near the right angle of the base of the prism. The walls 11*a*, 12*a* connect the sides 1*a* and 1*b* of the container 1 and the sides 1*a* and 1*c* of the container 1.

In the areas in which the walls 11*a*, 11*b*, on the one hand, and 12*a* and 12*b*, on the other hand, are respectively connected to the sides 1*b* and 1*c* of the prism the walls have been so formed as to provide in each case a groove 13*a*, 13*b* and 14*a*, 14*b* respectively. The grooves 13*a*, 13*b*, 14*a*, 14*b* are parallel to the corners of the container 1 and slightly narrower than the rim 6 of the headlight 5. The grooves 13*a*, 13*b* are positioned opposite one another as are the grooves 14*a*, 14*b*.

Near the bottom 8 of the container 1 each of these two seats has, between the walls 11*a*, 11*b* on the one hand, and the walls 12*a*, 12*b*, on the other hand, shaped projections 15 the upper surfaces of which are slightly rounded so as to conform to the parabolic profile of the casing 5*b* of the headlights 5. Each seat has two projections 15 symmetrically positioned with respect to its median plane parallel to the corners of the prism, the two projections 15 being adjacent the grooves 13*a*, 13*b* or 14*a*, 14*b* and positioned slightly behind these grooves, that is to say, toward the interior of the prism.

It should be noted that, in the container 1, open spaces have been provided between the walls (1*a*, 11*a*), (11*b*, 12*b*), (1*a*, 12*a*). This arrangement, on the one hand, makes it possible to increase the safety of the package in case of shock so as to avoid damage to the headlights stored therein and, on the other hand, to decrease the quantity of material which is required to manufacture the container. Furthermore, the empty spaces make it possible to store therein accessories sold at the same time as the headlights, for example accessories necessary to mount the headlights.

In the part near the bottom 8 of the container 1, the walls 11*a*, 11*b* of one seat and 12*a*, 12*b* of the other seat are connected to each other by a transverse partition 16 the upper edge of which is rounded so as to conform substantially to the shape of the back part 7 of the headlights 5. The lower edge of the openings 9 and 10 formed respectively in each of the side walls 1*b* and 1*c* is rounded in like manner so that the curve of the lower edge of these projections is substantially an arc of a circle having a diameter approximating the diameter of the lenses 5*a* of the projectors 5. The thickness of the walls 1*b* and 1*c* is greater than the curvature of the lenses 5*a* of projector 6 so that, regardless of the curvature of the lenses, they do not project beyond the outside of the package.

In order to introduce a headlight into a seat provided for this purpose in the container 1, for example into the seat defined between the walls 11*a* and 11*b*, the rim of the lens of the headlight is slid into the grooves 13*a*, 13*b*, and the headlight is introduced into its seat by pressing it lightly since the width of the grooves is slightly less than the thickness of the rim of the headlight 5. The headlight is thus introduced into the container like a drawer into a cabinet. The forcible introduction permits it to hold the headlight. The choice of a material having a certain elasticity for the container makes it possible to avoid any damage to the grooves when the headlight is being placed in position and thus permits subsequent reuse of the package. Moreover, the introduction of the headlights into their seat causes a slight separation of the edges of the openings 9 and 10 in the zone furthest from the bottom 9 of the container 1. When the cover 2 is placed on the container 1 the elasticity of the material of the container is relied upon to return to its original value the distance between the edges of the openings 9 and 10 so as to permit the cover to be forced down. This increases the grip on the headlight by acting laterally on the edges of the lens as with pliers, since the edges of the openings 9 and 10 are urged toward their respective median planes.

When a headlight 5 is positioned inside a seat provided for this purpose in the container 1, for example into the seat defined between the walls 11*a* and 11*b*, the lower part of the casing 5*b* rests on the shaped projections 15 and the rim 6 is seated inside the grooves 13*a*, 13*b*. The lens of the headlight is almost completely visible through the opening 9 formed in the sidewall 1*b*. The lens of the headlight is inset behind the outer surface of 1*b*. The back end 7 of the headlight rests on the curved edge defining the upper edge of the transverse wall 16.

It will be seen that the container which has just been described makes it possible to locate two headlights 5 symmetrically with respect to a plane bisecting the dihedral right angle of the container. The headlights 5 are perfectly insulated from shocks and perfectly retained inside their respective seats. The cover 2 is placed on the container by sliding it thereon parallel to the corners of the container and the ports 3 permit the possible purchaser to see the headlights without having to open the package. The handle 4 permits easy transportation of the package in complete safety. This package is advantageously stored on the bottom 8 of the container so that the lenses 5*a* of the projectors 5 are on their edges, which constitutes an additional safety measure.

Figure 1:
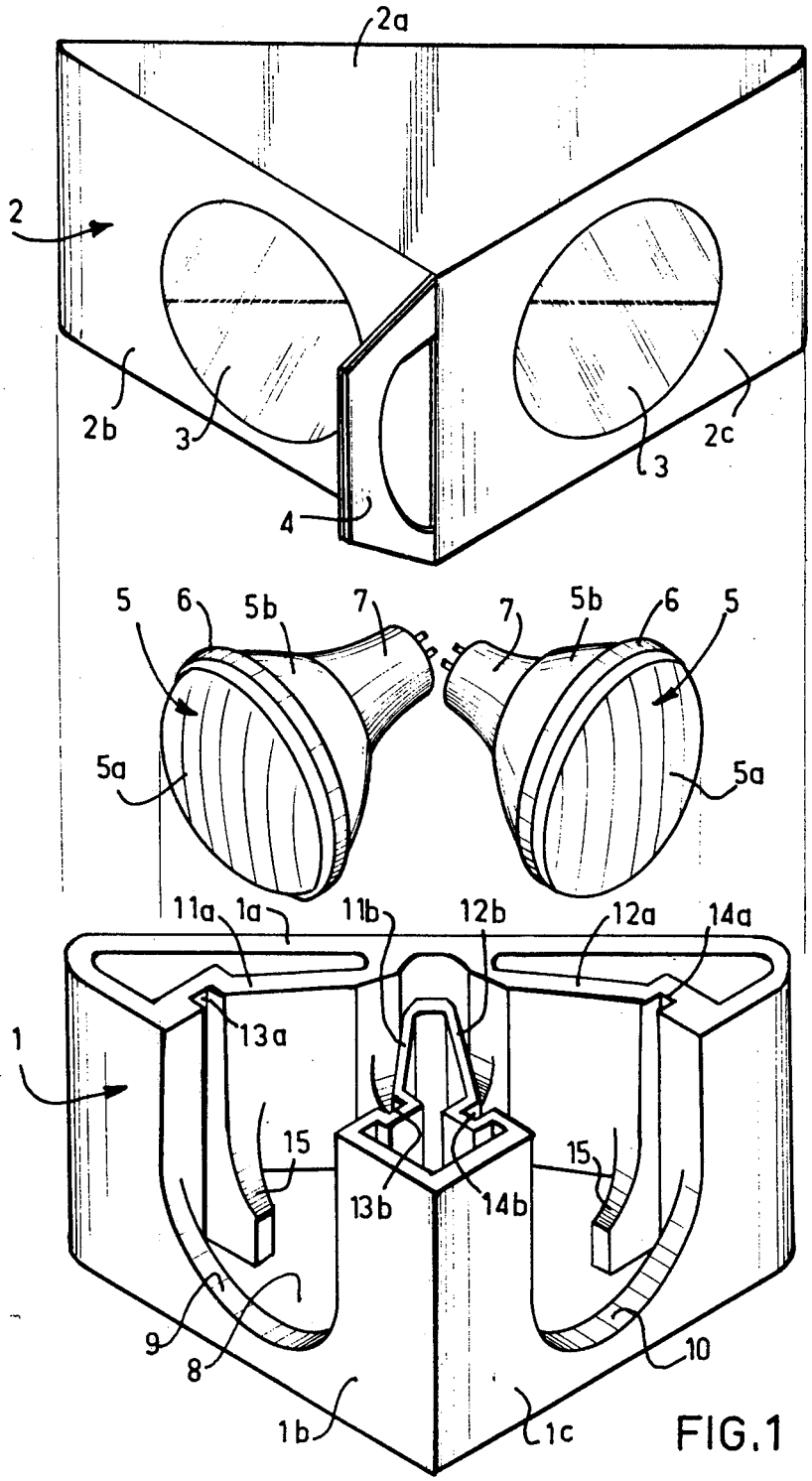
FIG. 1 is an exploded perspective view showing a display package according to the invention adapted to receive two automotive headlights.
Figure 2:
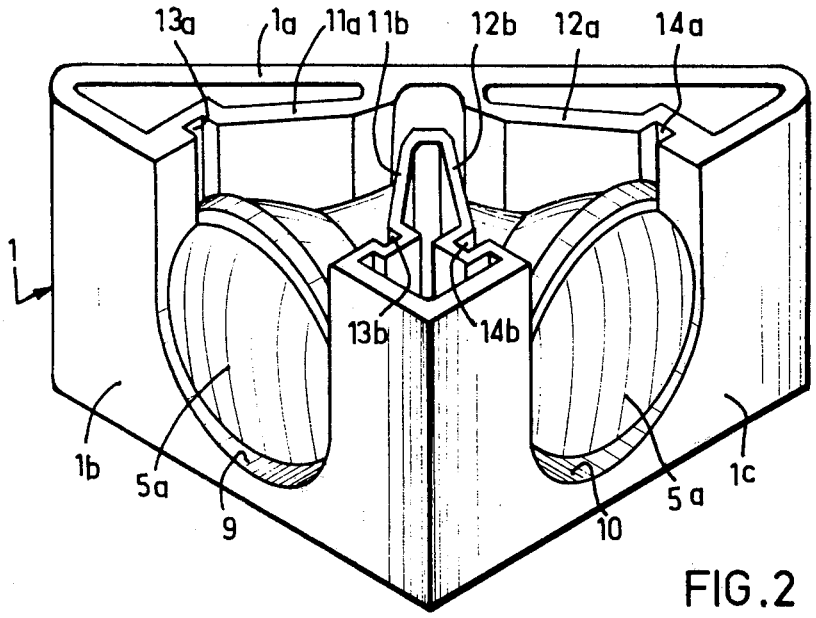
FIG. 2 is a perspective view showing the display package of FIG. 1 with two headlights in position in the package.
Figure 3:
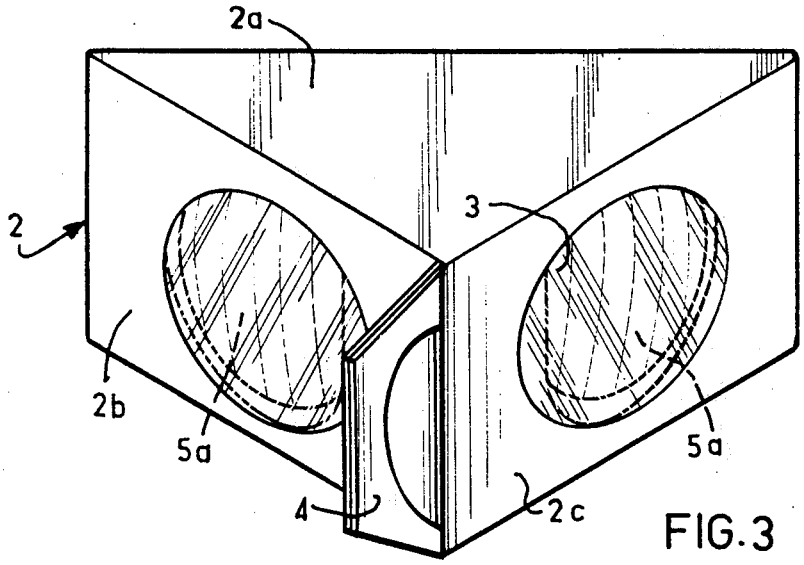
FIG. 3 shows the container of FIG. 1 covered by its associated cover.
Figure 4:
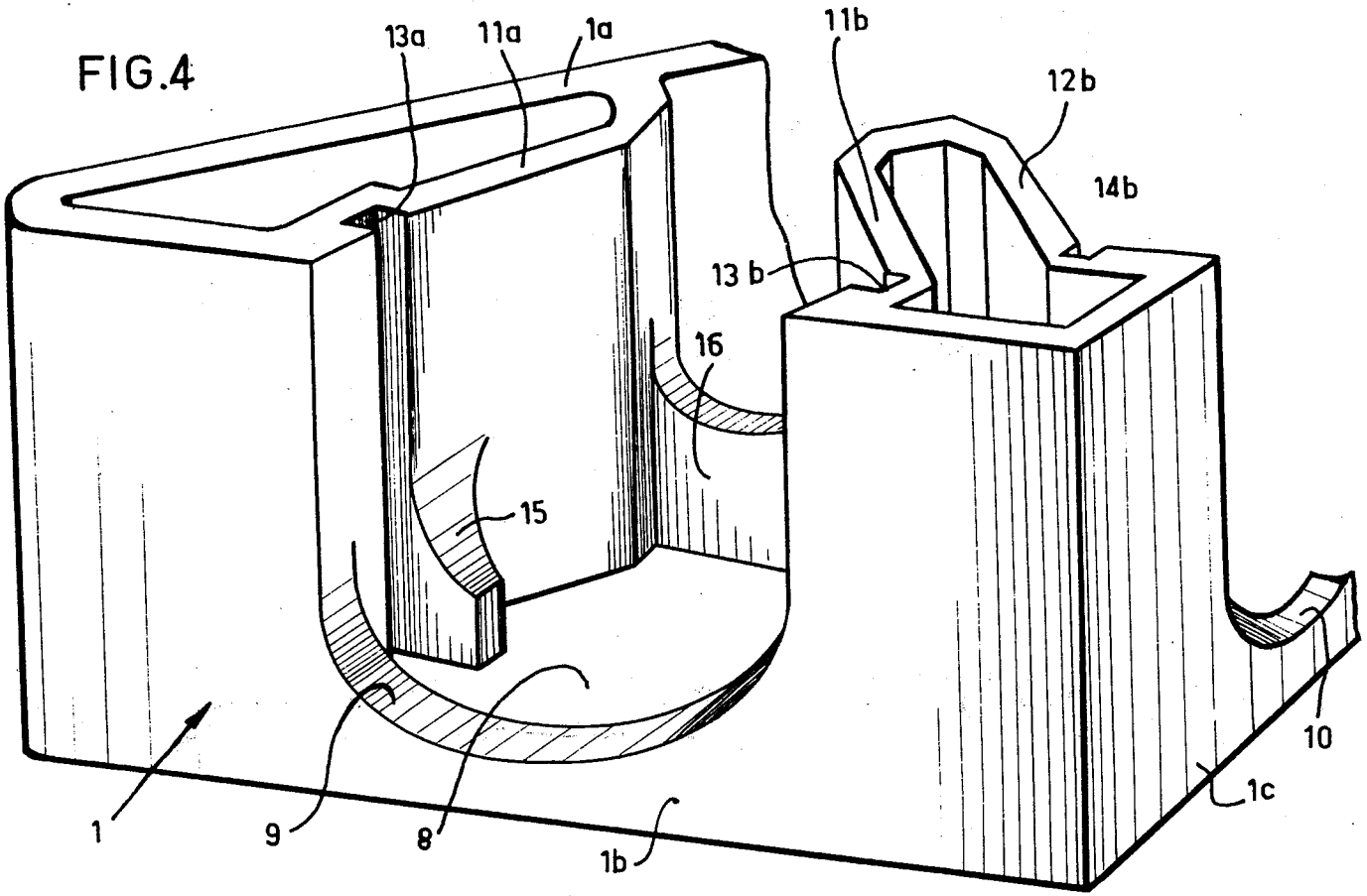
FIG. 4 is a partial detail view of the receptacle of the package of FIG. 1 shown in perspective.
Figure 5:
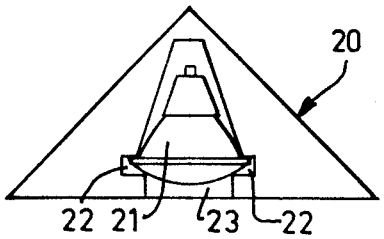
FIG. 5 is a schematic plan view of a display package according to the invention adapted to receive an automotive headlight.

FIG. 5 schematically shows a container having a base 20 in the shape of a right isosceles triangle, and adapted to store a single headlight 21 for an automobile. The headlight 21 is positioned inside a seat analogous to the one which has been described in connection with the container 1 of FIG. 1, the edges of the lens of the headlight being positioned inside the two grooves 22 on opposite sides of the seat, in back of the opening 23 leading to this seat and formed in one of the side walls of the prism. In such an embodiment the cover associated with the container 20 has a prismatic surface defining a port in its side wall which is aligned with the opening 23, said prismatic surface having the general characteristics which have been described in detail for the cover 2 of FIG. 1.

Figure 6:
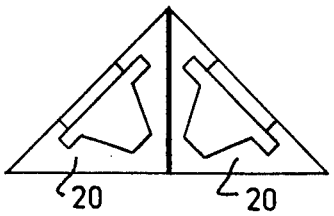
FIG. 6 is a schematic plan view showing a display package comprising two identical containers inside a single cover each adapted to receive an automotive headlight.

FIG. 6 represents another embodiment in which two identical containers 20 are associated together and positioned side by side, these two containers being adapted to be introduced into a single cover having a prismatic surface the two lateral walls of which grip the assembly of the two containers 20. This variation makes it possible to store two headlights in two identical container cells, which may be desirable in order to standardize the manufacture of the container.

Figure 7:
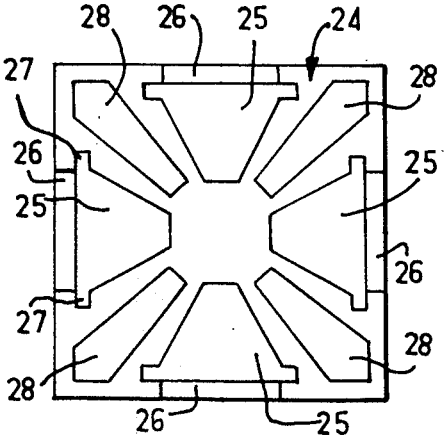
FIG. 7 is a schematic plan view showing a display package in which the container has a square base, said package being adapted to receive four automotive headlights.

FIG. 7 shows another embodiment in which the container 24 consists of a prism having a square bottom and defining four identical seats 25 each rotated 90° from the other with respect to the axis of the prism which passes through the center of the square bottom. Each of the seats 25 may be reached through an opening 26 in one of the side walls of the prism, behind which are positioned two grooves 27 which are symmetrical with respect to the median plane of the seat. Two successive seats 25 are separated by an open space 28 which makes it possible as has already been indicated on the one hand to increase the safety of the storage in the case of shock and, on the other hand, to decrease the quantity of material necessary to manufacture the container 24. The container 24 is associated with a cover formed by a prismatic surface having a square base, the lateral walls of the prismatic surface being connected to each other by a bottom which is fitted over the top of the container 24 through which the four seats 25 open.

FIG. 8 shows another embodiment of the display package according to the invention. This embodiment makes it possible to store therein a plurality of headlights. In this embodiment the container is formed by a right prism having a rectangular bottom 29 and in which identical seats 30 have been provided. These seats are positioned head to tail and staggered, all the median planes of the seats 30 being parallel and perpendicular to the longer sides of the rectangular bottom of the container 29. The seats 30 open through one or the other of the lateral surfaces of the container 29 which correspond to the longer sides of the rectangular bottom of said container. The corresponding openings have been indicated by reference numeral 31. Each seat 30 comprises, behind its opening 31, two grooves 32 parallel to the corners of the prism and symmetrical with respect to the median plane of the seat 30. The container 29 thus has the form of an elongated strip, the length of which may be longer or shorter depending upon the number of headlights which are to be stored in the container. The cover which is associated with the container 29 may, for example, consist of a plate or film which covers those surfaces of the prism 29 through which the seats 30 open.

FIG. 9 shows in detail another embodiment of the grooves which may be formed in the seats provided in the containers of the display packages according to the invention.

This embodiment may be used in combination with any of the embodiments previously described. It consists in providing, in each seat in which a headlight is to be placed, a series of grooves having different widths and depths, the entrance planes of said grooves being at different distances from the median plane of the seat in question. In the partial section of FIG. 9 reference numeral 33 indicates the material from which the container is made and 34 the opening in a side wall of the prism which leads to the seat. Behind the opening 34, on opposite sides of the median plane of the seat, are three grooves 35, 36 and 37 which permit three different types of headlights to be located in the seat, each headlight having lens edges which are of different thickness and different depths, the curvatures of the lenses being also different. This embodiment makes it possible to utilize identical containers for the storage of different headlights and thus makes it easier to standardize the manufacture of the containers.

It will of course be appreciated that the various embodiments hereinbefore described have been given purely by way of illustration and example and may be modified as to detail without thereby departing from the basic principles of the invention.

What is claimed is:

1. Display package for storing at least one fragile article comprising a container in the form of a prism having a polygonal bottom, at least one of the sides of the prism being partially hollowed out to define at least one seat open to the outside of the prism through the top thereof, each seat formed in the container having, on each side of the median plane of the seat parallel to the corners of the prism, and behind the outer surface of said at least one side, at least one groove substantially parallel to the corners of the prism.

2. Display package as claimed in claim 1 in which the container is a right prism.

3. Display package as claimed in claim 1 in which said median plane of each seat is substantially perpendicular to the outer surface of said at least one side.

4. Display package as claimed in claim 1 in which each seat in the container is laterally defined by walls parallel to the corners of said prism.

5. Display package as claimed in claim 1 in which projections extend into the part of each seat which is furthest from the outside of the prism, said projections being shaped to mate with the exterior of the article to be stored in the seat.

6. Display package as claimed in claim 1 in which the material of the prism is elastically deformable and each groove has a width slightly less than the thickness of an edge of the article to be stored therein which cooperates with said groove.

7. Display package as claimed in claim 1 in which the maximum dimension of the article to be stored measured perpendicularly to said at least one groove is slightly greater than the distance between the bottom of the groove and the wall of the seat opposite said groove bottom.

8. Display package as claimed in claim 7 in which the wall opposite said groove bottom is the bottom of another groove.

9. Display package as claimed in claim 1 adapted to be used when the article stored is a vehicle headlight and in which each seat comprises, in the zone farthest from the surface of said at least one side, at least one shaped projection extending into the seat behind the groove or grooves.

10. Display package as claimed in claim 1 in which each seat comprises in the zone farthest from the surface of said at least one side at least one shaped projection transversely connecting the two lateral walls defining the seat, said shaped projection being rounded and supporting the rear of the headlight.

11. Display package as claimed in claim 1 in which a cover is associated with the container and has a prismatic surface, the two side walls of which are connected to each other by a bottom, said side walls and cover defining an internal volume adapted to receive the prismatic container, the side walls of the cover being provided with a transparent zone in alignment with each opening formed in a side of the prismatic container which leads to a seat and the bottom of the cover overlying the top of the container.

12. Display package as claimed in claim 1 in which the shape of the polygonal bottom of the prism which constitutes the container is selected from the group consisting of a triangle, a square and a rectangle.

13. Display package as claimed in claim 12 adapted to store two identical articles and in which the polygonal bottom of the prism is a right isosceles triangle, with a seat opening into each of the faces of the prism which corresponds to one of the equal sides of said isosceles triangle.

14. Display package as claimed in claim 13 in which median planes in each seat parallel to the corners of the prism lie along a straight line parallel to the corners of the prism passing through the middle of the hypotenuse of the triangular bottom of the prism.

15. Display package as claimed in claim 13 in which the cover comprises a handle extending along one corner at the apex of the right angle of the triangle which constitutes the bottom of the cover.

16. Display package as claimed in claim 1 in which the polygonal bottom of the prismatic container is a rectangle and in which said container forms an elongated strip inside which the seats are positioned to receive the articles stored head to tail and staggered, with all of the median planes of the seats being perpendicular to the longest sides of the elongated strip, and the distance between two consecutive median planes being slightly greater than the maximum width of an article to be stored therein measured parallel to said longest sides.

17. Display package as claimed in claim 1 in which each seat provided in the prismatic container comprises several parallel grooves on the same side of its median plane parallel to the corners of the prism.

18. Display package as claimed in claim 17 in which the parallel grooves on the same side of the median plane of a seat have different widths and depths and are positioned at different distances from the median plane of the seat.

19. Display package having a cover which simultaneously grips several independent containers having the characteristics set forth in claim 1.

20. Display package as claimed in claim 1 in which the container is made of an expanded plastic material.

* * * * *